US011425806B2

(12) United States Patent
Ye et al.

(10) Patent No.: US 11,425,806 B2
(45) Date of Patent: Aug. 23, 2022

(54) LIGHTING APPARATUS

(71) Applicant: XIAMEN LEEDARSON LIGHTING CO., LTD, Fujian (CN)

(72) Inventors: Hemu Ye, Fujian (CN); Wei Liu, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/219,440

(22) Filed: Mar. 31, 2021

(65) Prior Publication Data

US 2021/0315078 A1 Oct. 7, 2021

(30) Foreign Application Priority Data

Apr. 3, 2020 (CN) ..... 202020475833.4

(51) Int. Cl.

| | |
|---|---|
| ***H05B 45/37*** | (2020.01) |
| ***H05B 47/19*** | (2020.01) |
| ***H05B 45/325*** | (2020.01) |
| ***H05B 47/115*** | (2020.01) |
| ***H05B 45/46*** | (2020.01) |
| ***H05B 45/345*** | (2020.01) |

(52) U.S. Cl.

CPC ..... *H05B 45/325* (2020.01); *H05B 45/345* (2020.01); *H05B 45/37* (2020.01); *H05B 45/46* (2020.01); *H05B 47/115* (2020.01); *H05B 47/19* (2020.01)

(58) Field of Classification Search

CPC ..... H05B 45/10; H05B 45/30; H05B 45/32; H05B 45/325; H05B 45/345; H05B 45/37; H05B 45/46; H05B 47/10; H05B 47/115; H05B 47/19

See application file for complete search history.

(56) References Cited

U.S. PATENT DOCUMENTS

| | | | | |
|---|---|---|---|---|
| 2013/0020955 | A1* | 1/2013 | Igaki | H05B 45/10 315/201 |
| 2014/0210362 | A1* | 7/2014 | Shin | H05B 45/48 315/186 |
| 2020/0413514 | A1* | 12/2020 | Qiu | H05B 45/40 |

* cited by examiner

*Primary Examiner* — Jimmy T Vu

(74) *Attorney, Agent, or Firm* — Chun-Ming Shih; Lanway IPR Services

(57) ABSTRACT

A lighting apparatus includes a rectifier, a constant current circuit, a first LED series, a second LED series, a third LED series and a controller. The rectifier converts an alternating current power to a direct current power. The constant current circuit generates a first driving current, a second driving current and a third driving current derived from the direct current power. The controller has a first mode to only turn on the first LED series and to turn off the second LED series and the third LED series. The controller has a second mode to adjust the first PWM signal, the second PWM signal and the third PWM signal to generate a corresponding color temperature.

20 Claims, 10 Drawing Sheets

LIGHTING APPARATUS

FIELD

The present invention is related to a lighting apparatus, and more particularly related to a lighting apparatus with color temperature control.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

Light efficiency is a key factor when designing a light device. It is important to use multiple types of light sources to obtain a mixed light effect.

However, it is important to enhance light efficiency when trying to increase flexibility of light devices. Therefore, it is beneficial to design a circuit design that may get balance among multiple factors in light device design. Light efficiency is a key factor when designing a light device. It is important to use multiple types of light sources to obtain a mixed light effect.

However, it is important to enhance light efficiency when trying to increase flexibility of light devices. Therefore, it is beneficial to design a circuit design that may get balance among multiple factors in light device design. Light efficiency is a key factor when designing a light device. It is important to use multiple types of light sources to obtain a mixed light effect.

However, it is important to enhance light efficiency when trying to increase flexibility of light devices. Therefore, it is beneficial to design a circuit design that may get balance among multiple factors in light device design. Light efficiency is a key factor when designing a light device. It is important to use multiple types of light sources to obtain a mixed light effect.

However, it is important to enhance light efficiency when trying to increase flexibility of light devices. Therefore, it is beneficial to design a circuit design that may get balance among multiple factors in light device design.

SUMMARY

In some embodiments, a lighting apparatus includes a rectifier, a constant current circuit, a first LED series, a second LED series, a third LED series and a controller.

The rectifier converts an alternating current power to a direct current power.

The constant current circuit generates a first driving current, a second driving current and a third driving current derived from the direct current power.

The first LED series emits a light of a main color temperature.

The first LED series includes a first number of first LED modules.

The second LED series emits a second light of a low color temperature lower than the main color temperature.

The second LED series includes a second number of second LED modules.

The third LED series emits a third light of a high color temperature higher than the main color temperature.

The third LED series includes a third number of third LED modules.

The first number is larger than the second number and the third number.

The controller generates a first PWM signal, a second PWM signal and a third PWM signal.

The constant current circuit generates the first driving current supplied to the first LED series according to the first PWM signal.

The constant current circuit generates the second driving current supplied to the second LED series according to the second PWM signal.

The constant current circuit generates the third driving current supplied to the third LED series according to the third PWM signal.

The controller has a first mode to only turn on the first LED series and to turn off the second LED series and the third LED series.

The controller has a second mode to adjust the first PWM signal, the second PWM signal and the third PWM signal to generate a corresponding color temperature.

In some embodiments, the rectifier converts the alternating current power of a first frequency to the direct current power of a second frequency.

The second frequency is two times of the first frequency.

In some embodiments, the lighting apparatus may also include a manual switch connected to the controller for switching between the first mode and the second mode.

In some embodiments, when the controller turns on the second LED series as a backup light source in the first mode when the controller further detects an abnormal status of the first LED series.

In some embodiments, the lighting apparatus may also include a motion sensor coupled to the controller for detecting whether there is human around the lighting apparatus.

If human is not detected around the light apparatus, the controller turns on the second LED series and the third LED series for the first LED series to rest to increase an overall life span of the lighting apparatus.

In some embodiments, the controller has a wireless circuit for receiving an external command from an external device.

The external command selects the first mode or the second mode.

In some embodiments, the external command indicates a color temperature value.

The controller converts the color temperature value to a set of corresponding first PWM signal, second PWM signal and the third PWM signal.

In some embodiments, the controller determines the first PWM signal, the second PWM signal and the third PWM signal by finding a configuration corresponding to the color temperature value in a table stored in a memory device.

In some embodiments, the first LED series has a first MOS switch for turning on the first driving current according to the first PWM signal.

The second LED series has a second MOS switch for turning on the second driving current according to the second PWM signal.

The third LED series has a third MOS switch for turning on the third driving current according to the third PWM signal.

In some embodiments, the first PWM signal is transmitted to a first gate terminal of the first MOS switch.

The second PWM signal is transmitted to a second gate terminal of the second MOS switch.

The third PWM signal is transmitted to a third gate terminal of the third MOS switch.

In some embodiments, the main color temperature is between 2500K and 2800K.

The low color temperature is between 1800K and 2400K.

The high color temperature is between 3700K to 4200K.

In some embodiments, the first number is larger than two times of the second number.

In some embodiments, the first number is larger than a sum of the second number and the third number.

In some embodiments, the lighting apparatus may also include a bulb shell and a bulb cap.

The controller, the rectifier and the constant current circuit are placed on a driver plate enclosed by the bulb cap.

The first LED series, the second LED series and the third LED series are disposed on a light source plate.

The driver plate is disposed perpendicularly to the light source plate.

In some embodiments, the first LED modules surround the second LED modules and the third LED modules on a light source plate.

In some embodiments, the second LED modules and the third LED modules surround the first LED modules on a light source plate.

In some embodiments, the first LED modules, the second LED modules, and the third LED modules are arranged in an alternating mixing order on a light source plate.

In some embodiments, the lighting apparatus may also include a power supply for generating a separate power supplied to the controller.

In some embodiments, the first LED series, the second LED series and the third LED series are disposed in parallel on an elongated light source plate.

In some embodiments, light intensities of the first LED series, the second LED series and the third LED series are adjusted by changing the first PWM signal, the second PWM signal and the third PWM signal together to adjust an overall intensity of the lighting apparatus.

DETAILED DESCRIPTION

Figure 5:
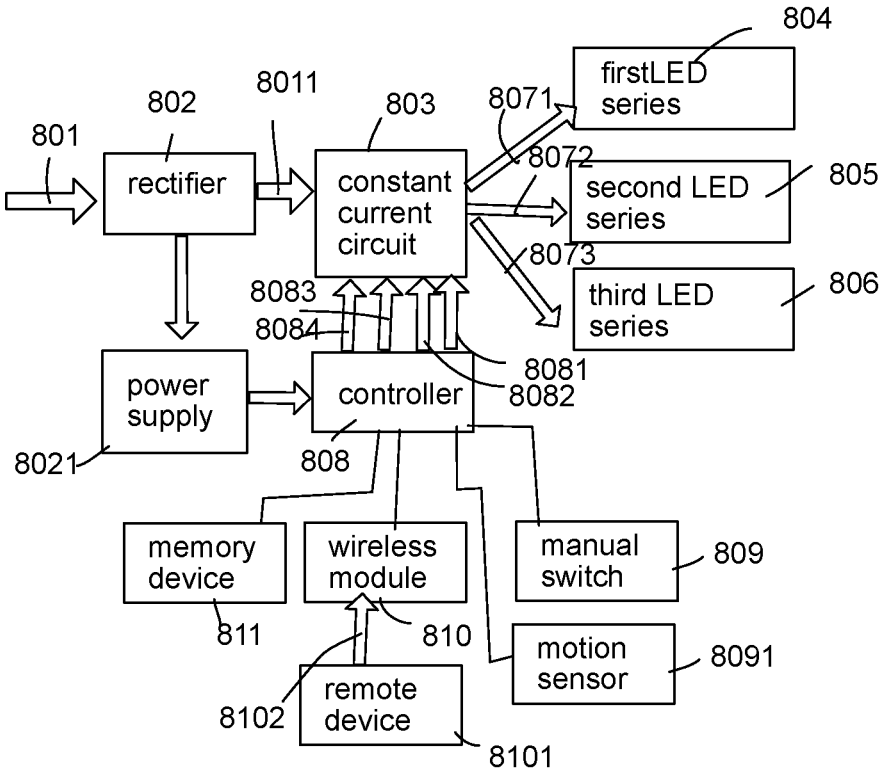
FIG. 5 illustrates another embodiment of a lighting apparatus.

In FIG. 5, a lighting apparatus includes a rectifier 802, a constant current circuit 803, a first LED series 804, a second LED series 805, a third LED series 806 and a controller 808.

The controller 808 may be made as an integrated circuit or other forms of a circuit. The controller 808 may be integrated with the constant current circuit 803 as an integrated circuit. The constant current 803 may be controlled by a PWM signal 8081 generated by the controller 808 for adjusting an overall intensity of a constant current output.

PWM refers to Pulse Width Modulation, which is a control mechanism for using a pulse signal to adjust an output current of a power circuit. The duty ratio of the pulse signal is used for increasing or decreasing the output current of the power circuit. The constant current circuit 803 may be implemented with various models known to persons of ordinary skilled in the art. For example, persons of ordinary skilled in the art may select a constant current circuit that generates a constant current output kept unchanged corresponding to a PWM signal. When the duty ratio of the PWM signal is changed, the constant current output may be changed to another level. Details of the constant current circuit are not repeated here for brevity.

The rectifier 802 converts an alternating current power 801 to a direct current power 8011. For example, the alternating current power 801 is an alternating current of 110V or 220 50 Hz power. The rectifier 802 may be a bridge rectifier that converts the 50 Hz AC power to a 100 Hz DC power. The frequency is doubled during the rectifying.

The constant current circuit generates a first driving current 8071, a second driving current 8072 and a third driving current 8073 derived from the direct current power 8011.

The first LED series 804 emits a light of a main color temperature.

Figure 6:
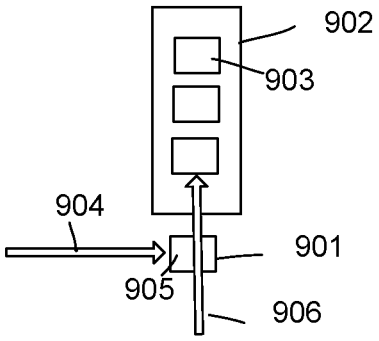
FIG. 6 illustrates a LED series example.

The first LED series includes a first number of first LED modules. In FIG. 6, a first LED series 902 has multiple first LED modules 903 connected in series. A MOS (Metal Oxide Semiconductor) switch 901 is connected to the first LED modules 903 with a first gate connected to a first PWM signal 904. A MOS In other words, when the first PWM signal 904 is at high level, the first driving current 906 is supplied to the first LED modules 903. When the first PWM signal 904 is at low level, the first driving current 906 is blocked. The second LED series and the third LED series may have similar structures as illustrated in FIG. 6.

Please refer back to FIG. 5.

The second LED series 805 emits a second light of a low color temperature lower than the main color temperature.

The second LED series includes a second number of second LED modules.

The third LED series 806 emits a third light of a high color temperature higher than the main color temperature.

The third LED series includes a third number of third LED modules.

The first number is larger than the second number and the third number. For example, there are 12 LED modules for the first LED series while there are 4 LED modules for the second LED series and the third LED series.

The controller 808 generates a first PWM signal 8082, a second PWM signal 8083 and a third PWM signal 8083. In FIG. 5, the first PWM signal 8082, the second PWM signal 8083, and the third PWM signal 8083 are supplied to the constant current circuit 803 for generating the first driving current, the second driving current and the third driving current directly, unlike the example illustrated in FIG. 6.

The constant current circuit 803 generates the first driving current 8071 supplied to the first LED series according to the first PWM signal.

The constant current circuit 803 generates the second driving current 8072 supplied to the second LED series according to the second PWM signal.

The constant current circuit 803 generates the third driving current 8073 supplied to the third LED series according to the third PWM signal.

The controller has a first mode to only turn on the first LED series and to turn off the second LED series and the third LED series.

The controller has a second mode to adjust the first PWM signal, the second PWM signal and the third PWM signal to generate a corresponding color temperature.

In some embodiments, the rectifier converts the alternating current power of a first frequency to the direct current power of a second frequency.

The second frequency is two times of the first frequency.

In some embodiments, the lighting apparatus may also include a manual switch 809 connected to the controller 808 for switching between the first mode and the second mode.

In some embodiments, when the controller 808 turns on the second LED series as a backup light source in the first mode when the controller further detects an abnormal status of the first LED series. For example, the controller 808 detects a current signal of the first LED series to detect whether there is any abnormal status. If the first LED series has problem, the second LED series and/or the third LED series is turned on to replace the function of the first LED series, to make the lighting apparatus to still work for a period of time.

This is particularly helpful when the first LED series are working for most of time. With the design, when the controller is operated in the first mode, the second LED series and the third LED series are turned off completely, thus increasing an overall light efficiency. When people need more flexibility, the controller enters the second mode and uses the second LED series and the third LED series to mix a required color temperature.

In some embodiments, the lighting apparatus may also include a motion sensor 8091 coupled to the controller 808 for detecting whether there is human around the lighting apparatus.

If human is not detected around the light apparatus, the controller turns on the second LED series and the third LED series for the first LED series to rest to increase an overall life span of the lighting apparatus. In such design, the first LED series is working for most of time and may decrease a life span. When people are not below the lighting apparatus, the controller replaces use of the first LED series with the second LED series and the third LED series, thus to increase an overall life span of the lighting apparatus. In addition, the first LED series is taking a break so that heat of the first LED series may be lowered down.

In some embodiments, the controller has a wireless circuit, e.g. a wireless module 810 of a Bluetooth, Wi-Fi or other protocols, for receiving an external command 8102 from an external device 8101.

The external command selects the first mode or the second mode.

In some embodiments, the external command indicates a color temperature value.

The controller converts the color temperature value to a set of corresponding first PWM signal, second PWM signal and the third PWM signal. For example, the color temperature value may be a value between 1 to 10, corresponding to different color temperature levels.

In some embodiments, the controller determines the first PWM signal, the second PWM signal and the third PWM signal by finding a configuration corresponding to the color temperature value in a table stored in a memory device 811.

The table has a mapping relation for the controller to convert the external command to corresponding control signals.

In some embodiments, the first LED series has a first MOS switch for turning on the first driving current according to the first PWM signal.

The second LED series has a second MOS switch for turning on the second driving current according to the second PWM signal.

The third LED series has a third MOS switch for turning on the third driving current according to the third PWM signal.

In some embodiments, the first PWM signal is transmitted to a first gate terminal of the first MOS switch.

The second PWM signal is transmitted to a second gate terminal of the second MOS switch.

The third PWM signal is transmitted to a third gate terminal of the third MOS switch.

These examples are illustrated and explained in FIG. 6.

In some embodiments, the main color temperature is between 2500K and 2800K.

The low color temperature is between 1800K and 2400K.

The high color temperature is between 3700K to 4200K.

In some embodiments, the first number is larger than two times of the second number. For example, there are 20 LED modules in the first LED series, and less than 10 LED modules in the second LED series and the third LED series.

In some embodiments, the first number is larger than a sum of the second number and the third number. For example, there are 20 LED modules in the first LED series and the sum of the second LED series and the third LED series are less than 20 LED modules.

Figure 7:
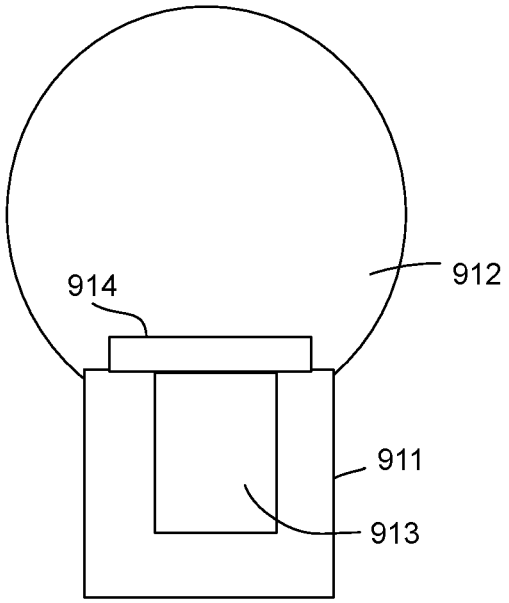
FIG. 7 illustrates a bulb example.

In FIG. 7, the lighting apparatus may also include a bulb shell 912 and a bulb cap 911.

The controller, the rectifier and the constant current circuit are placed on a driver plate 913 enclosed by the bulb cap 911.

The first LED series, the second LED series and the third LED series are disposed on a light source plate 914.

The driver plate 913 is disposed perpendicularly to the light source plate 914.

Figure 8:
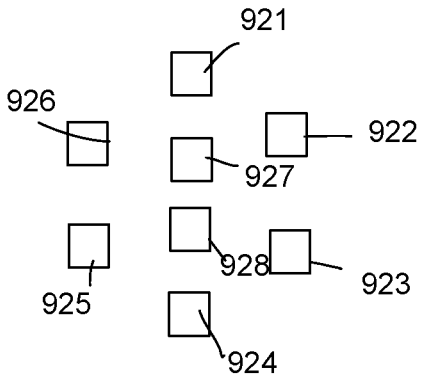
FIG. 8 illustrates a LED module arrangement.

In FIG. 8, the first LED modules 921, 922, 923, 924, 925, 926 surround the second LED modules 927 and the third LED modules 928 on a light source plate.

In some embodiments, the second LED modules and the third LED modules surround the first LED modules on a light source plate. FIG. 8 may be a reference for inverting the arrangement of the FIG. 8 to reach the example mentioned here.

Figure 9:
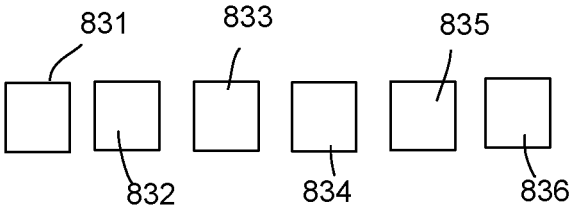
FIG. 9 illustrates a LED module arrangement.

In FIG. 9, the first LED modules 831, 832, 834, 835, the second LED modules 833, and the third LED modules 836 are arranged in an alternating mixing order on a light source plate.

In FIG. 5, the lighting apparatus may also include a power supply 8021 for generating a separate power supplied to the controller 808.

Figure 10:
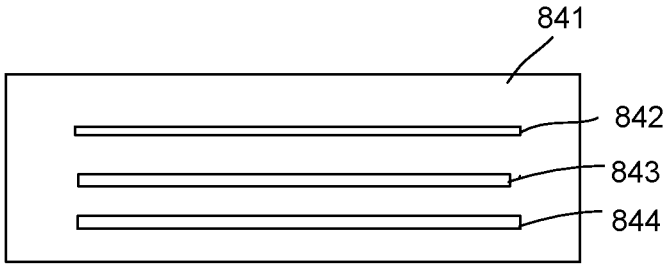
FIG. 10 illustrates a light tube embodiment.

In FIG. 10, the first LED series 842, the second LED series 843 and the third LED series 944 are disposed in parallel on an elongated light source plate 841.

In some embodiments, light intensities of the first LED series, the second LED series and the third LED series are adjusted by changing the first PWM signal, the second PWM signal and the third PWM signal together to adjust an overall intensity of the lighting apparatus.

Figure 1:
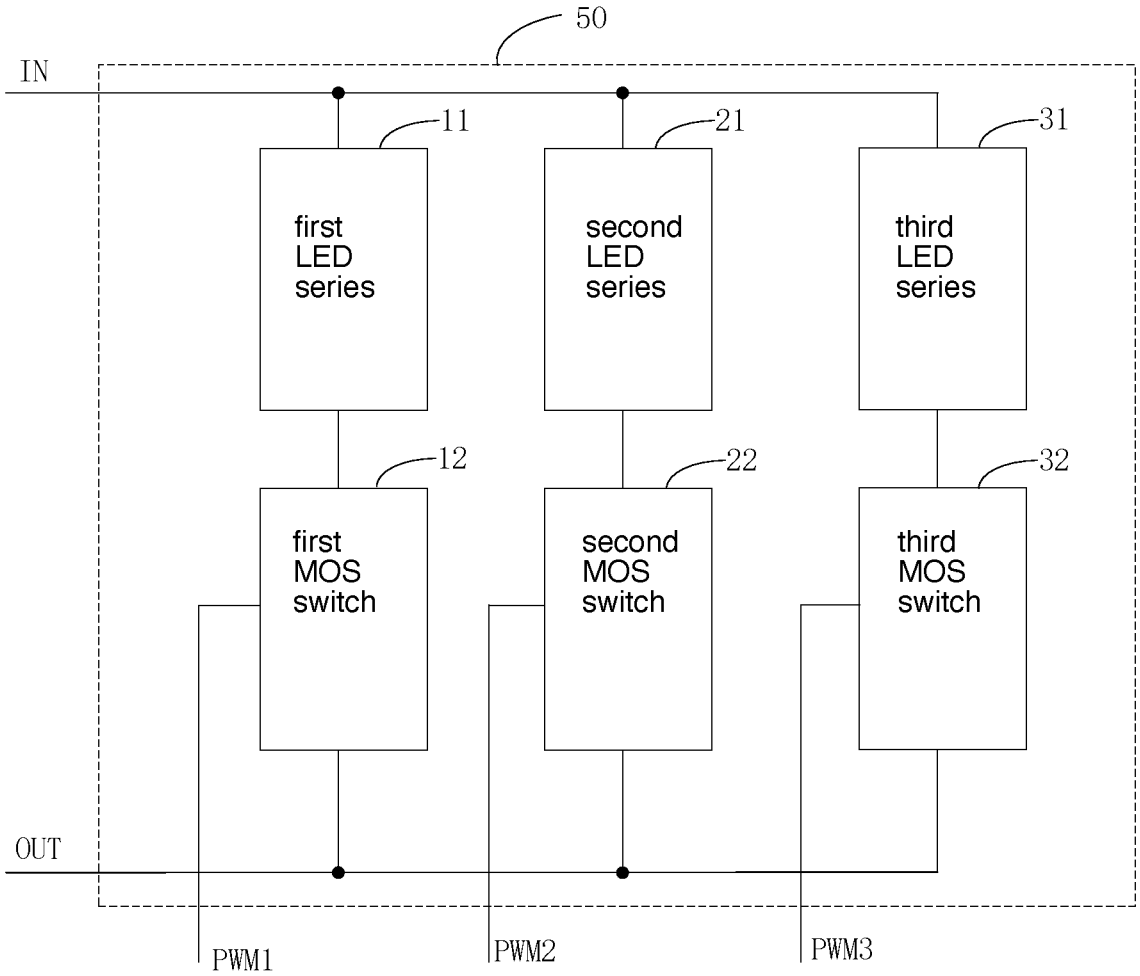
FIG. 1 illustrates a light source module example.

Please refer to FIG. 1.

In FIG. 1, a light source module 50 includes a first LED series 11, a second LED series 21, and a third LED series 31. There are three MOS switches, first MOS switch 12, second MOS switch 22 and third MOS switch 32 coupled to the first LED series 11, the second LED series 21 and the third LED series 31. As mentioned above, the first PWM signal PWM1, the second PWM signal PWM2, and the third PWM signal PWM3 supplied to the gate terminals of the three MOS switches 12, 22, 32.

Figure 2:
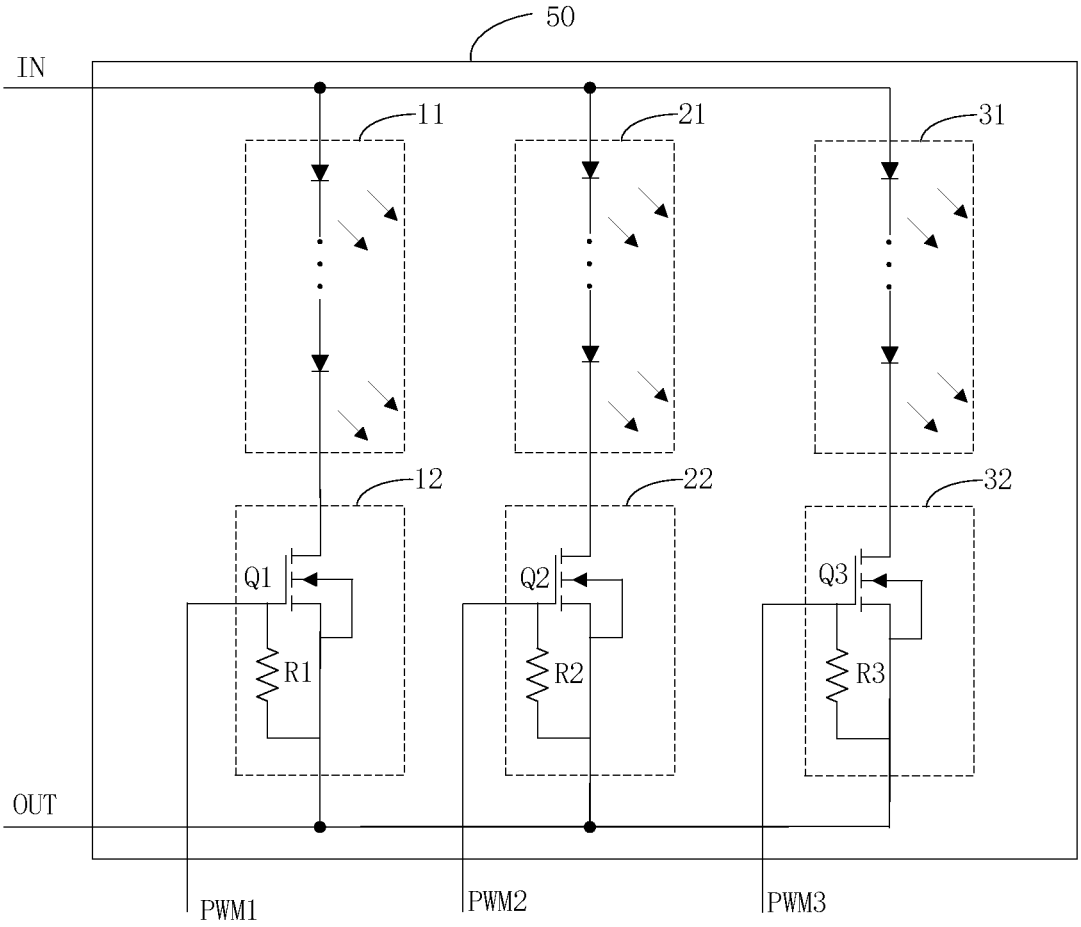
FIG. 2 illustrates another light source module example.

Please refer to FIG. 2. FIG. 2 shows a more detail diagram of the example in FIG. 1.

In FIG. 2, the three MOS switches 12, 22, 32 respectively have MOS devices Q1, Q2 and Q3 coupled with resistors R1, R2, R3 for controlling on or off of the driving currents supplied to the first LED series 11, the second LED series 21 and the third LED series 31.

Figure 3:
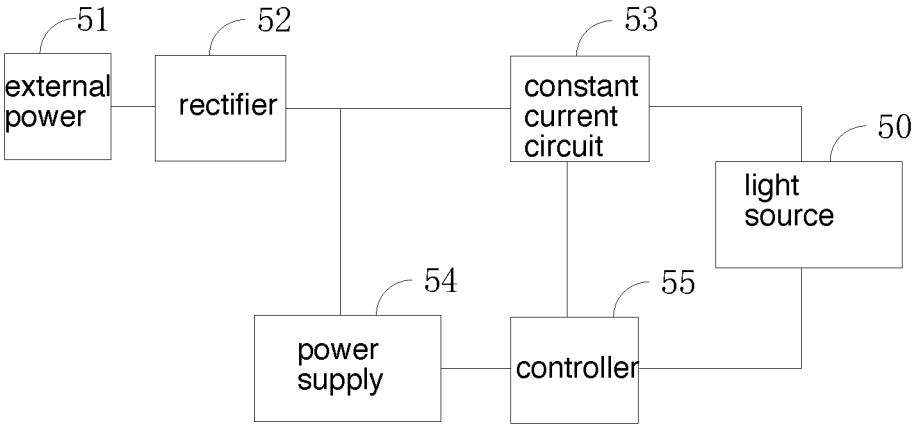
FIG. 3 illustrates a circuit diagram of a lighting apparatus embodiment.

Please refer to FIG. 3. In FIG. 3, the lighting apparatus receives an external power 51. The rectifier 52 converts the external power 51 for the constant current circuit 53. The controller 55 generates PWM signals for controlling the constant current circuit 53. The power supply 54 supplies power to the controller 55. The light source 50 may contain multiple LED series for providing lights in different modes as mentioned above.

Figure 4:
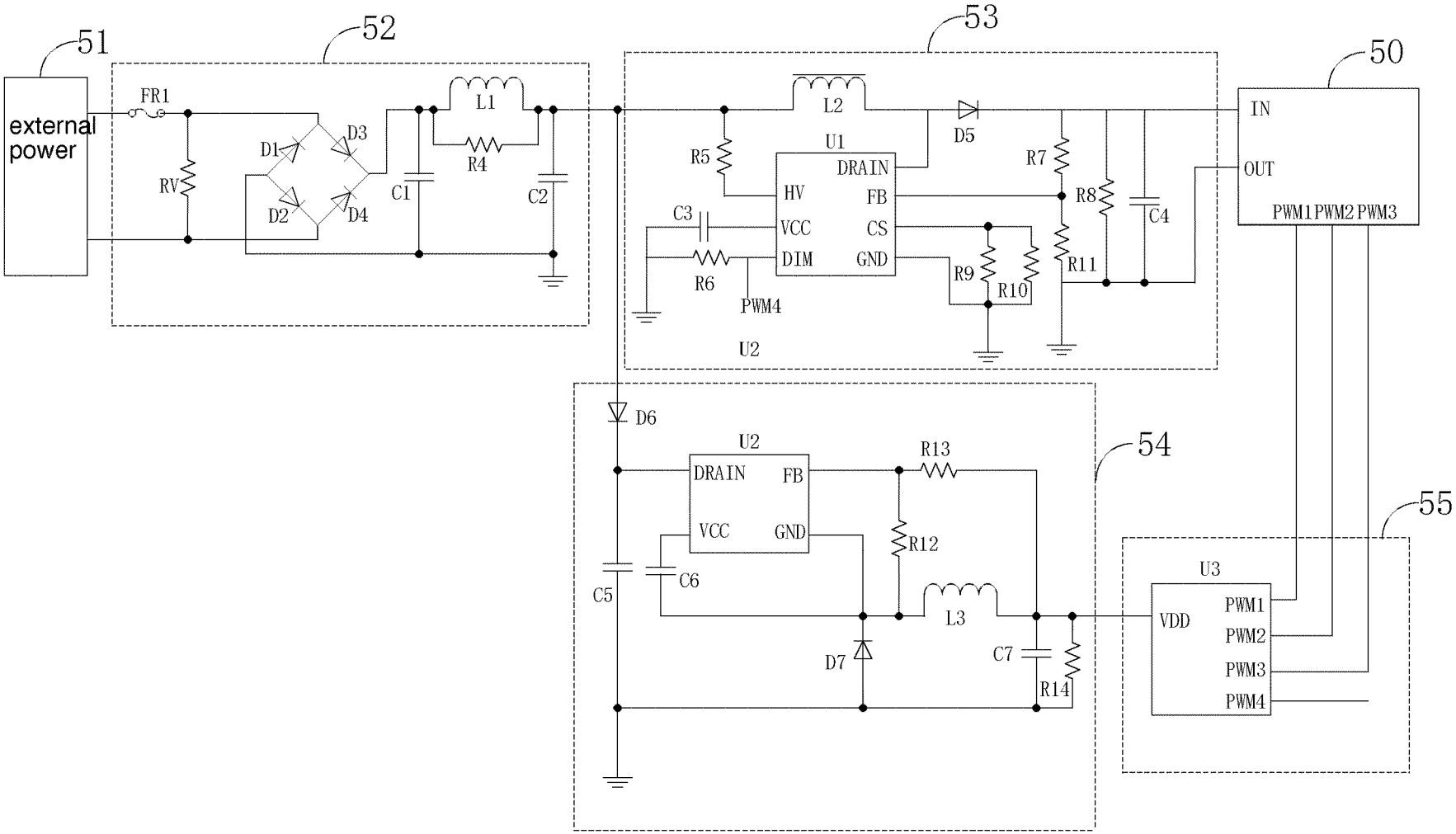
FIG. 4 illustrates a detailed example of a light apparatus embodiment.

FIG. 4 illustrates an example for implementing the embodiment in FIG. 3.

The rectifier 52 has diodes D1, D2, D3, D4, capacitors C1, C2, resistors RV, R4, conductor L1 and fuse FR1 as a bridge rectifier.

The constant current circuit 53 has an power chip U1 with capacitors C3, C4, diode D5, resistors R5, R6, R7, R8, R9, R10, R11, transformer coil L2.

The power supply 54 has a power chip U2 with resistors #12, R13, R14, capacitor C5, C6, C7, conductor L3, diode D6, inductor L3.

The controller 55 may include an integrated chip U3 for generating PWM signals PWM1, PWM2, PWM3, PWM4 supplying to the first LED series, the second LED series, the third LED series and an overall current level.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus comprising:

a rectifier for converting an alternating current power to a direct current power;

a constant current circuit for generating a first driving current, a second driving current and a third driving current derived from the direct current power;

a first LED series for emitting a light of a main color temperature, wherein the first LED series comprises a first number of first LED modules;

a second LED series for emitting a second light of a low color temperature lower than the main color temperature, wherein the second LED series comprises a second number of second LED modules;

a third LED series for emitting a third light of a high color temperature higher than the main color temperature, wherein the third LED series comprises a third number of third LED modules, the first number is larger than the second number and the third number; and a controller for generating a first PWM signal, a second PWM signal and a third PWM signal, wherein the constant current circuit generates the first driving current supplied to the first LED series according to the first PWM signal, the constant current circuit generates the second driving current supplied to the second LED series according to the second PWM signal, the constant current circuit generates the third driving current supplied to the third LED series according to the third PWM signal, the controller has a first mode to only turn on the first LED series and to turn off the second LED series and the third LED series, the controller has a second mode to adjust the first PWM signal, the second PWM signal and the third PWM signal to generate a corresponding color temperature.

2. The lighting apparatus of claim 1, wherein the rectifier converts the alternating current power of a first frequency to the direct current power of a second frequency, the second frequency is two times of the first frequency.

3. The lighting apparatus of claim 1, further comprising a manual switch connected to the controller for switching between the first mode and the second mode.

4. The lighting apparatus of claim 3, wherein when the controller turns on the second LED series as a backup light source in the first mode when the controller further detects an abnormal status of the first LED series.

5. The lighting apparatus of claim 3, further comprising a motion sensor coupled to the controller for detecting whether there is human around the lighting apparatus, if human is not detected around the light apparatus, the controller turns on the second LED series and the third LED series for the first LED series to rest to increase an overall life span of the lighting apparatus.

6. The lighting apparatus of claim 1, wherein the controller has a wireless circuit for receiving an external command from an external device, the external command selects the first mode or the second mode.

7. The lighting apparatus of claim 6, wherein the external command indicates a color temperature value, the controller converts the color temperature value to a set of corresponding first PWM signal, second PWM signal and the third PWM signal.

8. The lighting apparatus of claim 7, wherein the controller determines the first PWM signal, the second PWM signal and the third PWM signal by finding a configuration corresponding to the color temperature value in a table stored in a memory device.

9. The lighting apparatus of claim 1, wherein the first LED series has a first MOS switch for turning on the first driving current according to the first PWM signal, the second LED series has a second MOS switch for turning on the second driving current according to the second PWM signal, the third LED series has a third MOS switch for turning on the third driving current according to the third PWM signal.

10. The lighting apparatus of claim 9, wherein the first PWM signal is transmitted to a first gate terminal of the first MOS switch, the second PWM signal is transmitted to a second gate terminal of the second MOS switch, the third PWM signal is transmitted to a third gate terminal of the third MOS switch.

11. The lighting apparatus of claim 1, wherein the main color temperature is between 2500K and 2800K, the low color temperature is between 1800K and 2400K, the high color temperature is between 3700K to 4200K.

12. The lighting apparatus of claim 1, wherein the first number is larger than two times of the second number.

13. The lighting apparatus of claim 1, wherein the first number is larger than a sum of the second number and the third number.

14. The lighting apparatus of claim 1, further comprising a bulb shell and a bulb cap, wherein the controller, the rectifier and the constant current circuit are placed on a driver plate enclosed by the bulb cap, wherein the first LED series, the second LED series and the third LED series are disposed on a light source plate, the driver plate is disposed perpendicularly to the light source plate.

15. The lighting apparatus of claim 1, wherein the first LED modules surround the second LED modules and the third LED modules on a light source plate.

16. The lighting apparatus of claim 1, wherein the second LED modules and the third LED modules surround the first LED modules on a light source plate.

17. The lighting apparatus of claim 1, wherein the first LED modules, the second LED modules, and the third LED modules are arranged in an alternating mixing order on a light source plate.

18. The lighting apparatus of claim 1, further comprising a power supply for generating a separate power supplied to the controller.

19. The lighting apparatus of claim 1, wherein the first LED series, the second LED series and the third LED series are disposed in parallel on an elongated light source plate.

20. The lighting apparatus of claim 1, wherein light intensities of the first LED series, the second LED series and the third LED series are adjusted by changing the first PWM signal, the second PWM signal and the third PWM signal together to adjust an overall intensity of the lighting apparatus.

* * * * *